US011318744B2

(12) United States Patent
Ishida et al.

(10) Patent No.: US 11,318,744 B2
(45) Date of Patent: May 3, 2022

(54) LIQUID EJECTION HEAD SUBSTRATE AND MANUFACTURING METHOD OF THE SAME

(71) Applicant: CANON KABUSHIKI KAISHA, Tokyo (JP)

(72) Inventors: Yuzuru Ishida, Yokohama (JP); Takeru Yasuda, Kawasaki (JP); Tsubasa Funabashi, Oita (JP); Yoshinori Misumi, Tokyo (JP); Maki Kato, Fuchu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 7 days.

(21) Appl. No.: 16/928,326

(22) Filed: Jul. 14, 2020

(65) Prior Publication Data

US 2021/0016569 A1 Jan. 21, 2021

(30) Foreign Application Priority Data

Jul. 19, 2019 (JP) ..... JP2019-133802
May 22, 2020 (JP) ..... JP2020-089788

(51) Int. Cl.
*B41J 2/14* (2006.01)
*B41J 2/16* (2006.01)

(52) U.S. Cl.
CPC ..... *B41J 2/14072* (2013.01); *B41J 2/14129* (2013.01); *B41J 2/1642* (2013.01)

(58) Field of Classification Search
CPC .. B41J 2/14072; B41J 2/14129; B41J 2/1642; B41J 2/1603; B41J 2/1623; B41J 2/1628; B41J 2/1631; B41J 2/1646; B41J 2202/12; B41J 2202/18; B41J 2/1404
See application file for complete search history.

(56) References Cited

U.S. PATENT DOCUMENTS

| | | | | |
|---|---|---|---|---|
| 6,609,783 | B1 | 8/2003 | Koyama et al. | |
| 9,481,172 | B2 * | 11/2016 | Hirai | B41J 2/14233 |
| 10,438,912 | B2 | 10/2019 | Sasaki et al. | |
| 2018/0277503 | A1 | 9/2018 | Sasaki et al. | |
| 2020/0189277 | A1 | 6/2020 | Takeuchi et al. | |

FOREIGN PATENT DOCUMENTS

| | | | |
|---|---|---|---|
| JP | 2000-43271 | A | 2/2000 |
| JP | 2018-154090 | A | 10/2018 |

* cited by examiner

*Primary Examiner* — Lisa Solomon
(74) *Attorney, Agent, or Firm* — Venable LLP

(57) ABSTRACT

An electrode pad portion of a liquid ejection head substrate includes a layer containing one of an iridium metal and an iridium alloy, and at least a portion of a cavitation resistant layer is provided in the same layer with the same material as the layer containing one of the iridium metal and the iridium alloy.

11 Claims, 10 Drawing Sheets

LIQUID EJECTION HEAD SUBSTRATE AND MANUFACTURING METHOD OF THE SAME

BACKGROUND OF THE INVENTION

Field of the Invention

The present invention relates to a liquid ejection head substrate for ejecting liquid to perform recording on a recording medium, and a manufacturing method of the liquid ejection head substrate.

Description of the Related Art

In the related art, a bonding method such as wire bonding has been adopted to electrically connect a liquid ejection head substrate (hereinafter, may be simply referred to as an element substrate) constituting a liquid ejection head and an external substrate. A material of an electrode pad portion disposed on the element substrate is selected in consideration of connection reliability with a bonding material and a chemical resistance to chemicals such as acid, alkali and organic solvent used in a manufacturing step of a nozzle formed after manufacturing the element substrate. At present, the electrode pad portion has a laminated configuration from a lower layer, such as an aluminum layer used as a wiring layer of the element substrate, a barrier metal layer made of a material such as TiW, and an Au layer for connecting with the bonding material. The electrode pad portion is connected to an external substrate by wire bonding connection using a gold wire. At this time, a surface of the electrode pad portion is required to be flatter in order to secure the connection reliability with the bonding material.

On the other hand, before connecting the element substrate and the external substrate by wire bonding, an electrical inspection is performed so as not to mount an electrically defective element substrate (chip). For the electrical inspection, probing is performed in which an inspection probe is applied to the electrode pad portion. However, in the case of the current laminated film of Au layer/TiW layer/aluminum layer, since the Au layer and the aluminum layer are relatively soft materials, the electrode pad portion may be damaged (recessed) by probing. As a result, irregularities (referred to as probe mark) having a height difference of approximately 1 μm or more may be formed on the surface of the electrode pad portion. FIG. 10B is a diagram illustrating a state of generation of a probe mark 105 when an electrical inspection is performed using a probe 103 on the electrode pad portion having an aluminum layer 102 in the related art. As illustrated in FIG. 10A, the probe 103 is applied to the aluminum layer 102 and scanned in the arrow direction. This scanning distance is referred to as an overdrive amount, and a region in contact with the probe 103 is referred to as a probing region 104. As illustrated in FIG. 10B, in the probing region 104, the aluminum layer 102 is recessed, and the residue forms a large irregularity (probe mark 105) as a protrusion. A contact via 101 to a lower layer wiring (not illustrated) is indicated.

With respect to an occurrence of such a large irregularity, after a step of exposing the aluminum layer, an electrical inspection of a substrate is performed on the aluminum layer, and thereafter, a method is known in which a TiW layer is sputtered and an Au layer is formed thick by a plating method. By probing to a thin aluminum layer and filling a probe mark with a thick Au layer, an influence of probing in electrical inspection has been minimized and the reliability of connection during wire bonding has been secured. In addition, there is also a method of forming a pad electrode by forming a thick insulating layer that hides the probe mark and forming a through-hole in a region where there is no probe mark, instead of the thick Au layer.

However, the formation of a thick Au layer is costly, and a projection portion having a thick film is formed on the substrate, which may impair the uniformity in the surface of the substrate. The formation of a thick insulating layer also causes a stress to be applied to an entire substrate, and problems such as warpage of the substrate occur. Therefore, the following proposals have been made as a technique for thinning the Au layer without forming a thick insulating layer.

Japanese Patent Application Laid-Open No. 2000-43271 discloses a method of forming a film by electroless plating instead of forming an electrode film by a sputtering method and an electrolytic plating method. Here, the thin Au layer is formed on a nickel layer. The probe mark is covered by forming a thick nickel layer.

According to Japanese Patent Application Laid-Open No. 2018-154090, an opening is formed in an insulating layer that covers a wiring aluminum layer with the wiring aluminum layer to be the electrode pad portion leaving the surrounding aluminum layer. After removing the aluminum layer exposed in the opened insulating layer, a barrier metal and a gold layer are formed. Before removing the aluminum layer exposed on the insulating layer, the aluminum layer is probed to remove the probe mark by removing the aluminum layer on the exposed portion. As a result, an electrode can be formed of the thin Au layer.

Due to the miniaturization of ejection, a design is required in which a height of an ink flow path is low and an ejection orifice is short (that is, orifice plate is thin). According to Japanese Patent Application Laid-Open No. 2000-43271, although the Au layer can be thin and the cost can be kept low, the thick nickel layer may not meet a demand for miniaturization. According to Japanese Patent Application Laid-Open No. 2018-154090, each layer can be thin, so that it is possible to meet the demand for miniaturization, and it may be necessary to form a mask for removing the aluminum layer and a step due to the mask. In addition, the contact between the aluminum layer and the Au layer is contact on the side surface of the aluminum layer, and there is a concern that the contact resistance increases as a pad area decreases.

An object of the present invention is to provide a liquid ejection head in which a film thickness of an electrode pad portion is reduced, and a manufacturing method of the liquid ejection head including an electrical inspection by probing.

SUMMARY OF THE INVENTION

A liquid ejection head substrate includes a heating element that generates thermal energy for ejecting a liquid, an electrode pad portion for electrical connection with an outside, the electrode pad portion being electrically connected to the heating element, and a cavitation resistant layer formed so as to cover the heating element, in which the electrode pad portion includes a layer containing one of an iridium metal and an iridium alloy, and at least a portion of the cavitation resistant layer is provided in the same layer with the same material as the layer containing one of the iridium metal and the iridium alloy.

Further features of the present invention will become apparent from the following description of exemplary embodiments with reference to the attached drawings.

DESCRIPTION OF THE EMBODIMENTS

1. Embodiments to which the Present Invention can be Applied 1.1 Configuration of Liquid Ejection Head Hereinafter, an example of an embodiment to which the present invention can be applied will be described with reference to the drawings. However, the following description does not limit the scope of the present invention.

A recording device provided with a liquid ejection head of a type in which a liquid in a liquid chamber is heated by energizing a recording element (heating resistor), the film boiling of the liquid generated thereby causes the liquid to bubble in the liquid chamber, and a bubbling energy at this time causes the liquid droplet to be ejected from an ejection orifice is often used. In a case where recording is performed by such a recording device, a physical effect such as an impact due to cavitation generated when the liquid is bubbled, contracted, and defoamed in a region on the heating resistor may be exerted on the region on the heating resistor. A cavitation resistant layer may be disposed on the heating resistor to protect the heating resistor from one of physical and chemical effects on the heating resistor. The cavitation resistant layer is normally made of a metal material such as tantalum and iridium, and is disposed at a position in contact with the liquid.

In the present invention, attention was paid to one of iridium and an iridium alloy formed as the cavitation resistant layer, and it was studied to apply the same to an electrode pad.

(Description of Structure of Liquid Ejection Head Substrate)

Figure 1:
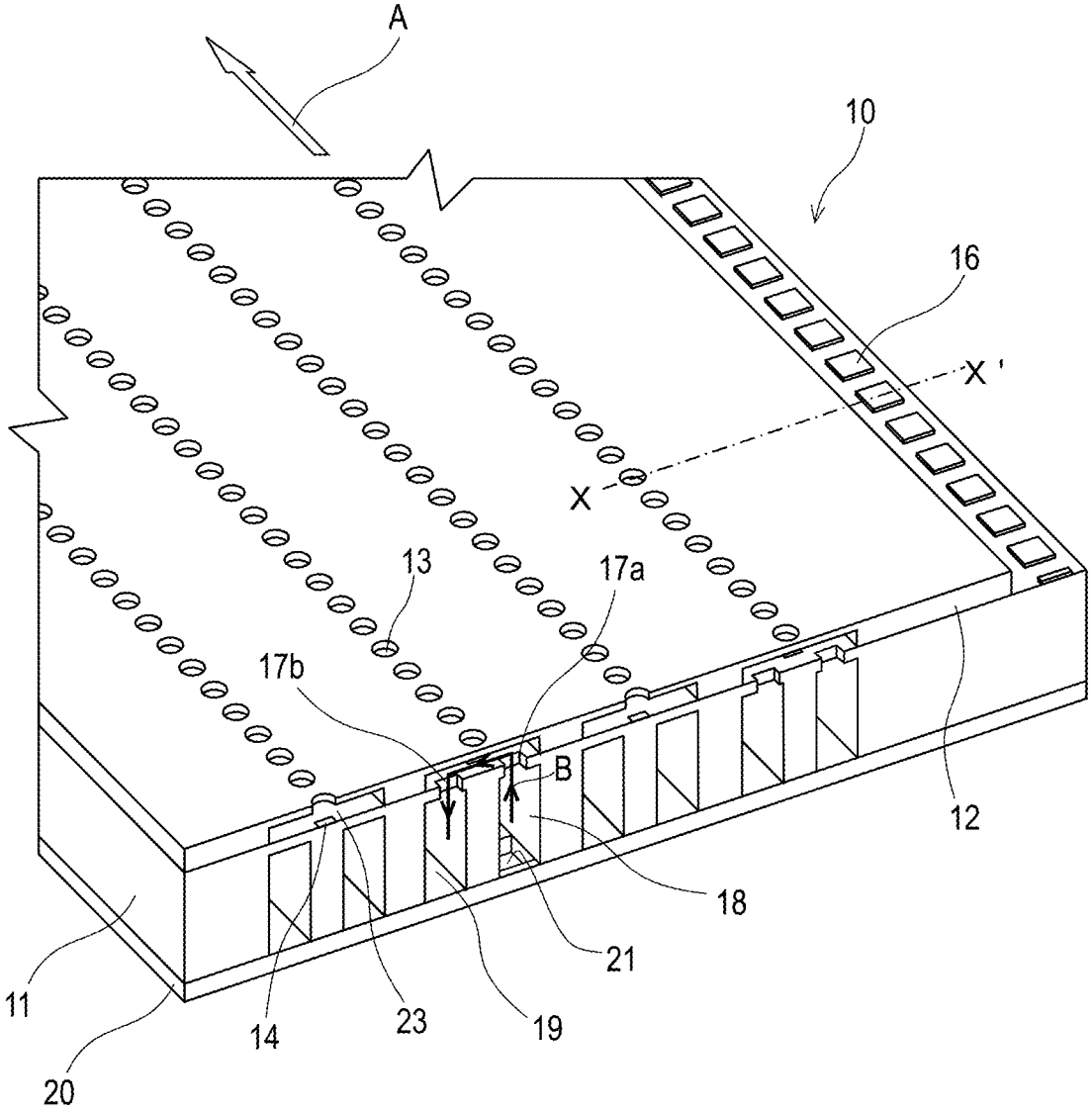
FIG. 1 is a schematic perspective view of a liquid ejection head substrate according to an embodiment to which the present invention can be applied.

FIG. 1 is a perspective view schematically illustrating a liquid ejection head substrate (hereinafter, also simply referred to as an element substrate) 10 according to an embodiment to which the present invention can be applied. A substrate 11 on which a liquid supply path is formed, an ejection orifice forming member 12 on a front surface side of the substrate 11, and a cover plate 20 on a rear surface side of the substrate 11 are formed on the element substrate 10. Four ejection orifice rows corresponding to respective ink colors are formed in the ejection orifice forming member 12 of the element substrate 10. Hereinafter, a direction where the ejection orifice row in which a plurality of liquid ejection orifices (hereinafter, simply referred to as an ejection orifice) 13 is disposed extends (arrow A) is referred to as an "ejection orifice row direction".

As illustrated in FIG. 1, a recording element 14 that generates energy for ejecting liquid is disposed at a position corresponding to each ejection orifice 13 in a liquid flow path that communicates with the ejection orifice. In the present example, the recording element 14 is a heating resistor element for bubbling the liquid by using thermal energy, and a liquid flow path (referred to as a pressure chamber) 23 that communicates with the ejection orifice provided with the recording element 14 therein is defined by the ejection orifice forming member 12. The recording element 14 is electrically connected to an electrode pad portion 16 disposed at an end portion of the substrate 11 by an electric wiring (not illustrated) provided on the element substrate 10, and generates heat based on a pulse signal input through an external wiring substrate (not illustrated) to boil the liquid. The liquid is ejected from the ejection orifice 13 by the bubbling force due to the boiling. In the present example, a liquid supply path 18 and a liquid recovery path 19, which are flow paths provided in the element substrate 10 and extending in the ejection orifice row direction, are provided, and communicate with the ejection orifice 13 through a supply port 17*a* and a recovery port 17*b*, respectively. A cover plate 20 includes an inlet 21 for supplying the liquid to the liquid supply path 18 from the outside, and an outlet (not illustrated) for discharging the liquid from the liquid recovery path 19 to the outside. By circulating the liquid with the outside in a direction of the arrow B through the liquid supply path 18 and the liquid recovery path 19, thickening of the liquid in the vicinity of the ejection orifice 13 is suppressed and the ejection performance of the liquid is stabilized. In the present embodiment, the heating element faces the pressure chamber and is covered with the cavitation resistant layer made of one of tantalum (Ta), iridium (Ir), and a laminated film thereof. In the present embodiment, a portion illustrated as the recording element 14 in FIG. 1 is provided with the cavitation resistant layer and is in contact with the liquid. In the present embodiment, although an iridium metal simple substance is used as at least a portion of the material of the cavitation resistant layer, an iridium alloy containing a small amount of elements such as osmium (Os) and platinum (Pt) may be used. Each of the recording elements 14 are connected to each other, are connected to the electrode pad portion 16 through the wiring provided inside the substrate 11, and a voltage is externally applied to the recording element 14 through the electrode pad portion 16.

Figure 2A:
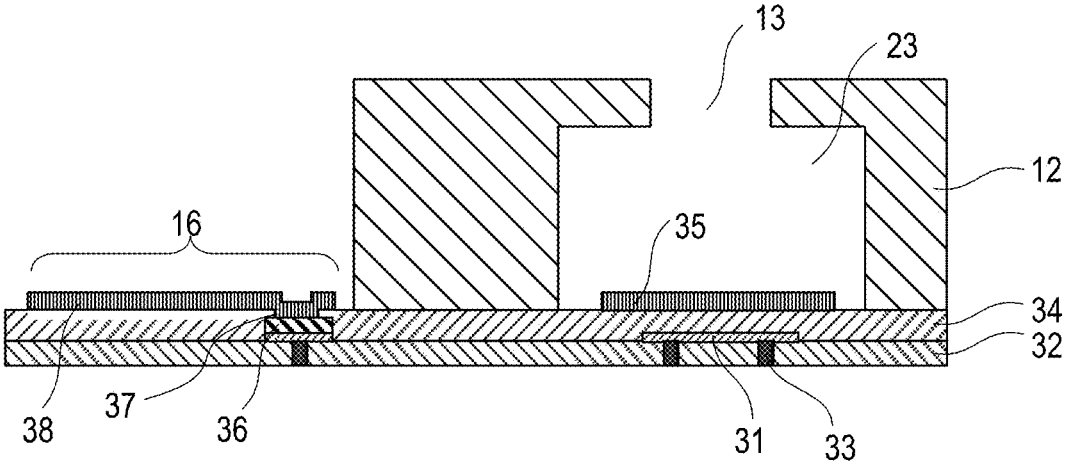
FIG. 2A is a schematic cross-sectional view of a liquid ejection head substrate according to a first embodiment to which the present invention can be applied.

FIG. 2A is a schematic cross-sectional view of the liquid ejection head substrate according to the first embodiment to which the present invention can be applied. This corresponds to a cross section of the element substrate 10 illustrated in FIG. 1 taken along line X-X'. In the figure, the vicinity of the ejection orifice forming member 12 and the electrode pad portion 16, and the vicinity of a heating resistor element (also referred to as a heating element) 31 which is a recording element disposed (so as to face the ejection orifice 13) directly below the ejection orifice 13 are schematically illustrated. A lower layer portion of the substrate 11 and the cover plate 20 disposed below these elements are omitted.

Figure 2B:
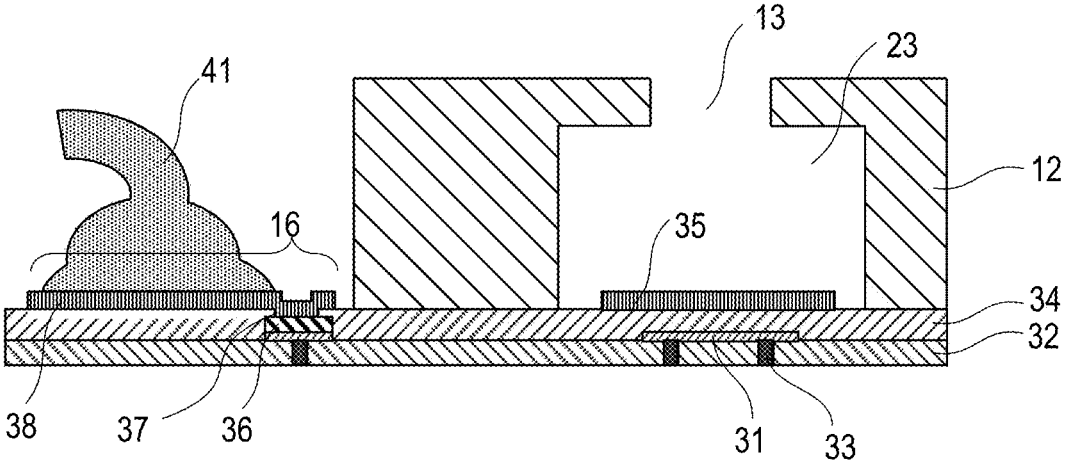
FIG. 2B is a schematic cross-sectional view of the liquid ejection head substrate and a wire member according to the first embodiment to which the present invention can be applied.

As illustrated in FIG. 2B, the heating element 31 made of a cermet material such as TaSiN and WSiN is formed on a heat storage layer 32 made of silicon oxide, and is electrically connected to an electrode plug 33 made of tungsten (W). Furthermore, an insulation protection layer 34 made of one of SiN, SiC, SiCN and a laminated layer thereof is formed so as to cover the heating element 31 and the electric wiring. Furthermore, on the insulation protection layer 34 above the heating element 31, a cavitation resistant layer 35 having a noble metal material such as Ir as the outermost layer is formed. That is, the heating element 31 is covered with the cavitation resistant layer 35 through the insulation protection layer 34. Here, as illustrated on a left side of FIG. 2A, a wiring lead-out layer 36, which is electrically connected to the heating element 31, is formed of, for example, one of aluminum and an alloy of aluminum and copper, and is a lower layer of the electrode pad portion 16, is disposed in the vicinity of the electrode pad portion 16. In addition, the wiring lead-out layer 36 is electrically connected to an upper layer 38 of the electrode pad portion 16 formed in the same layer with the same material as the cavitation resistant layer 35 made of Ir through the through-hole 37 formed in the insulation protection layer 34. In the present embodiment, as described above, the upper layer 38 of the electrode pad portion 16 and the cavitation resistant layer 35 on the heating element 31 are formed simultaneously (in the same manufacturing step). As a result, a manufacturing load can be suppressed. However, as long as the upper layer 38 of the electrode pad portion is formed of one of iridium and an iridium alloy, the upper layer 38 and the cavitation resistant layer 35 may be formed in separate steps, respectively. In addition, the wiring lead-out layer 36 that constitutes the lower layer of the electrode pad portion 16 may be formed by extending a portion of a wiring layer (not illustrated), and may be formed separately.

Regarding a laminated configuration of the electrode pad portion 16, a side electrically connected to the outside is referred to as an upper side and a front side, and a side opposite to these is referred to as a lower side. The upper and lower sides thereof do not change depending on a posture of the liquid ejection head substrate 10.

Since the material forming the upper layer 38 of the electrode pad portion 16 is Ir (including Ir), the material has resistance (chemical resistance) to an acid, alkali, and organic stripping solution used in a subsequent manufacturing step of an ejection orifice forming material, and is difficult to dissolve. In addition, from the viewpoint of cost, after the formation of the upper layer 38 of the electrode pad portion 16 and before the wire bonding illustrated in FIG. 2B, an electrical inspection for the element substrate is performed so that the defective chip is not mounted. The electrode pad portion 16 is electrically connected to an external substrate by one of wire bonding and lead bonding.

Figure 4A:
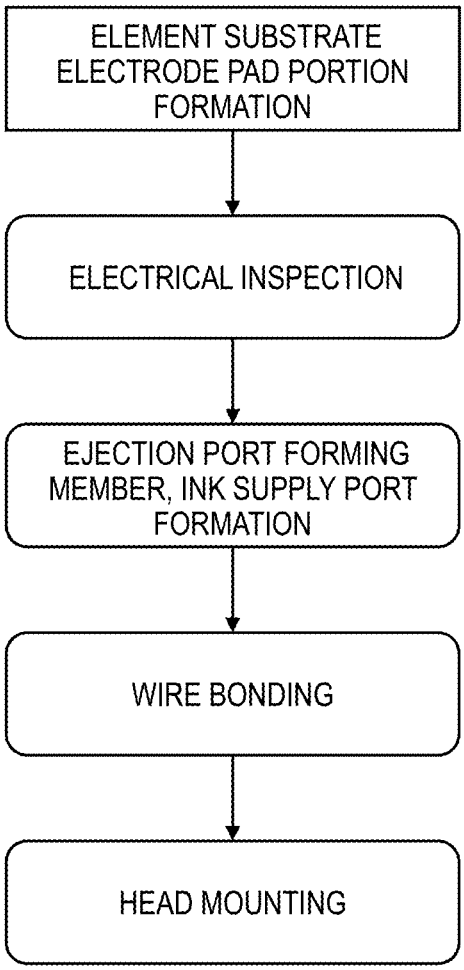
FIG. 4A is a flowchart describing a timing of an electrical inspection in a manufacturing method of the liquid ejection head substrate according to the embodiment to which the present invention can be applied.
Figure 4B:
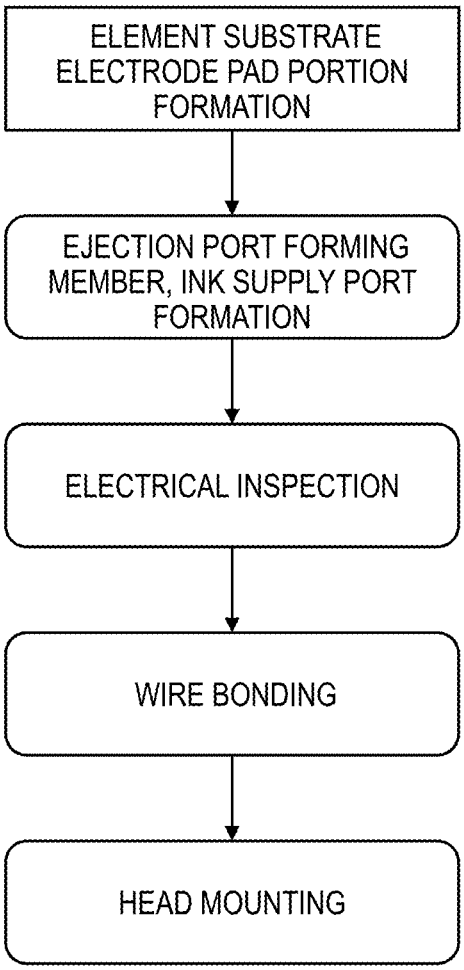
FIG. 4B is a flowchart of another aspect describing the timing of the electrical inspection in the manufacturing method of the liquid ejection head substrate according to the embodiment to which the present invention can be applied.

FIGS. 4A and 4B are a flowchart describing a timing of the electrical inspection. FIG. 4A illustrates an aspect in which an electrical inspection is performed after the electrode pad portion 16 is formed and before the ejection orifice forming member 12 is formed. FIG. 4B illustrates an aspect in which an electrical inspection is performed after the ejection orifice forming member 12 is formed and before wire bonding is performed.

Figure 10A:
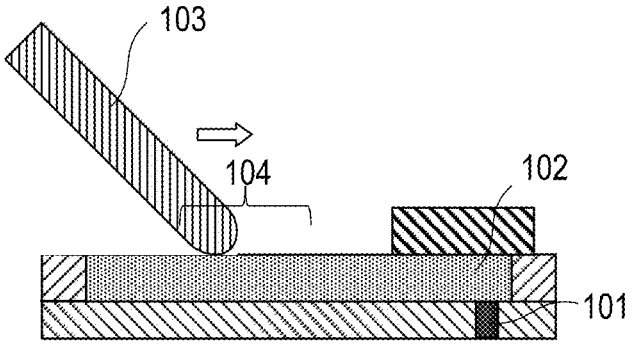
FIG. 10A is a schematic cross-sectional view illustrating probing in an aluminum pad in the related art.
Figure 10B:
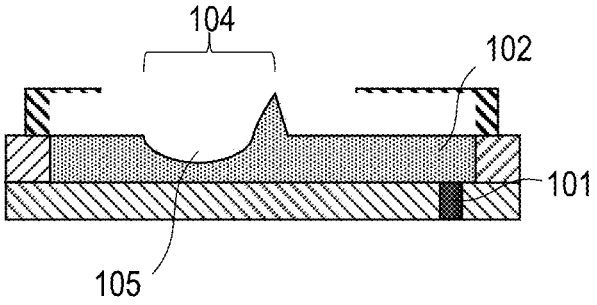
FIG. 10B is a schematic cross-sectional view illustrating a probe mark on the aluminum pad in the related art.

In the case of the aluminum pad in the related art, as illustrated in FIG. 10B, a probe mark 105, which is a large irregularity, was generated by probing by the electrical inspection. On the other hand, in the pad configuration of the present embodiment, since the upper layer 38 on the insulation protection layer is a layer made of Ir having a hardness higher than that of aluminum, even in probing in the electrical inspection, the probe mark is not attached and flatness is maintained.

FIG. 2B illustrates a schematic cross-sectional view of the vicinity of the pad portion 16 after wire bonding. As illustrated in FIG. 2B, since the flatness of the surface of the pad portion 16 is maintained, it is possible to suppress the deterioration of connectivity and electrical reliability in wire bonding without adding a step of filling and removing the probe mark as in the electrode pad configuration in the related art. In addition, since the flatness of the electrode pad portion 16 can be maintained even when the electrical inspection is performed as described above, it is possible to perform bonding on the probing region 104. Therefore, unlike the AL pad in the related art, it is not necessary to separate the probing region 104 and the bonding region, and an area of the electrode pad portion 16 can be reduced.

In addition, since the upper layer 38 of the pad portion 16 is made of Ir, which is a noble metal film that does not form a natural oxide film in the air atmosphere at room temperature, a step of removing the oxide film on the upper surface of the upper layer 38 may not be performed in the manufacturing step, and the load on the manufacturing step can be suppressed.

The configuration of the electrode pad portion 16 is not limited to the configuration having the upper layer 38 of a single layer structure illustrated in the present embodiment, and may be a configuration having the upper layer 38 of a multilayer structure. In the case of the multilayer structure, the surface on which probing is performed may be a layer containing one of iridium and an iridium alloy. In addition, the probing can be performed in a region such as the wiring lead-out layer 36 where there is no lower wiring layer (near the center of the electrode pad portion 16). However, depending on the thickness of the insulation protection layer 34, it is possible to perform probing without affecting the lower layer. Therefore, the wiring lead-out layer 36, which is the lower layer of the electrode pad portion, may be disposed below the probing region.

Figure 5:
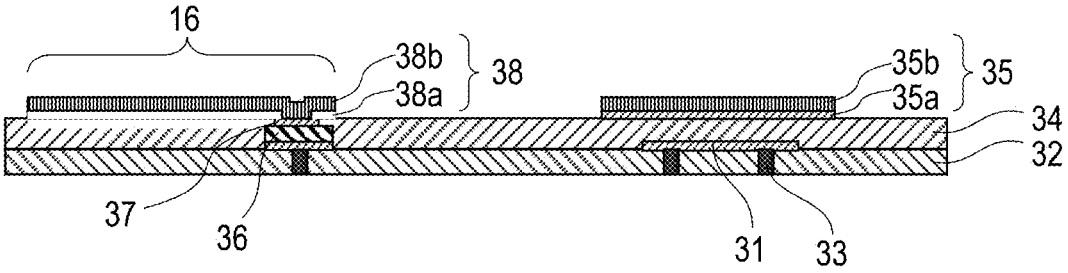
FIG. 5 is a schematic cross-sectional view of a liquid ejection head substrate according to a second embodiment to which the present invention can be applied.

FIG. 5 illustrates a cross-sectional view of a liquid ejection head substrate according to a second embodiment in which the upper layer 38 of the electrode pad portion 16 and the cavitation resistant layer 35 have a two-layer laminated structure of a Ta film (35*a* and 38*a*) as a first layer and an Ir film (35*b* and 38*b*) as a second layer. FIG. 5 is a view corresponding to FIG. 2A, in which the ejection orifice forming member 12 is omitted. By disposing the Ta film 35*a* in this manner, the adhesion between the insulation protection layer 34 and the cavitation resistant layer 35 can be improved.

Figure 6:
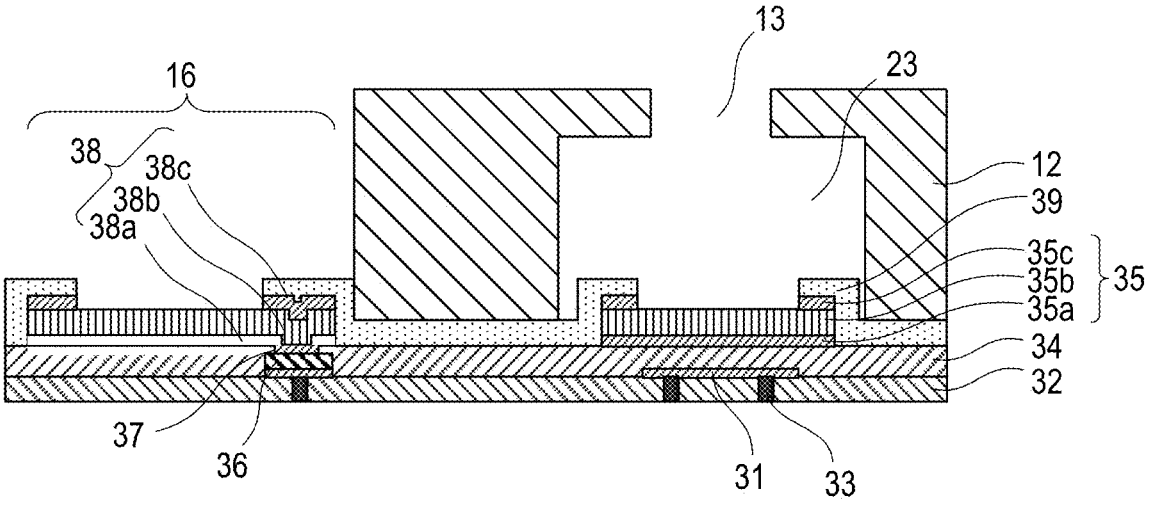
FIG. 6 is a schematic cross-sectional view of a liquid ejection head substrate according to a third embodiment to which the present invention can be applied.

FIG. 6 is a cross-sectional view of a liquid ejection head substrate according to a third embodiment in which the upper layer 38 of the electrode pad portion 16 and the cavitation resistant layer 35 have a three-layer laminated structure, and a view corresponding to FIG. 2A. This laminated structure includes a Ta film (35*a* and 38*a*) as a first layer, an Ir film (35*b* and 38*b*) as a second layer, and a Ta film (35*c* and 38*c*) as a third layer. Furthermore, an adhesion improving layer 39 is disposed so as to cover the laminated structure and improve the adhesion between the ejection orifice forming member and the substrate. On the electrode pad portion 16 and the heating element 31, the adhesion improving layer 39 is opened, and the Ta film (35*c* and 38*c*) as the third layer is removed to expose the Ir film (35*b* and 38*b*) as the second layer. At this time, from the viewpoint of manufacturing load, the adhesion improving layer 39 and the Ta film (35*c* and 38*c*) as the third layer can be removed in the same manufacturing step. That is, in the present embodiment, the layer used as the cavitation resistant layer 35 that covers the electrode pad portion 16 and the heating element 31 in the three-layer laminated structure is the first layer and the second layer. In this case as well, in the electrode pad portion 16, the Ir film in which the probe mark is unlikely to occur is exposed on the surface, and by probing on the surface, an electrode pad in which the probe mark is suppressed can be obtained.

Furthermore, by disposing the Ta film 35*c* of the upper layer in any region other than on the heating element 31 and the electrode pad portion 16, it can also be used as a low resistance electrical wiring, and the degree of freedom in the circuit layout is improved. However, at this time, in order to reduce the amount of warp of the wafer, the film thickness of the Ta film 35*c* of the upper layer is preferably 200 nm or less. In addition, taking the viewpoint of electric resistance into consideration, the film thickness of the Ta film 35*c* of the upper layer is more preferably 50 nm or more to 200 nm or less.

The adhesion improving layer 39 is a layer having a higher adhesion to the ejection orifice forming member 12 than the insulation protection layer 34, and is not particularly limited as long as the adhesion improving layer 39 is an insulating material. For example, an inorganic material such as SiC and SiCN can be suitably used.

As illustrated in FIG. 6, when the Ta film 38*c* as the third layer located at a portion on the upper side of the through-hole 37 is left, it is possible to cover the step difference caused by the through-hole 37 and ensure the flatness.

Figure 8A:
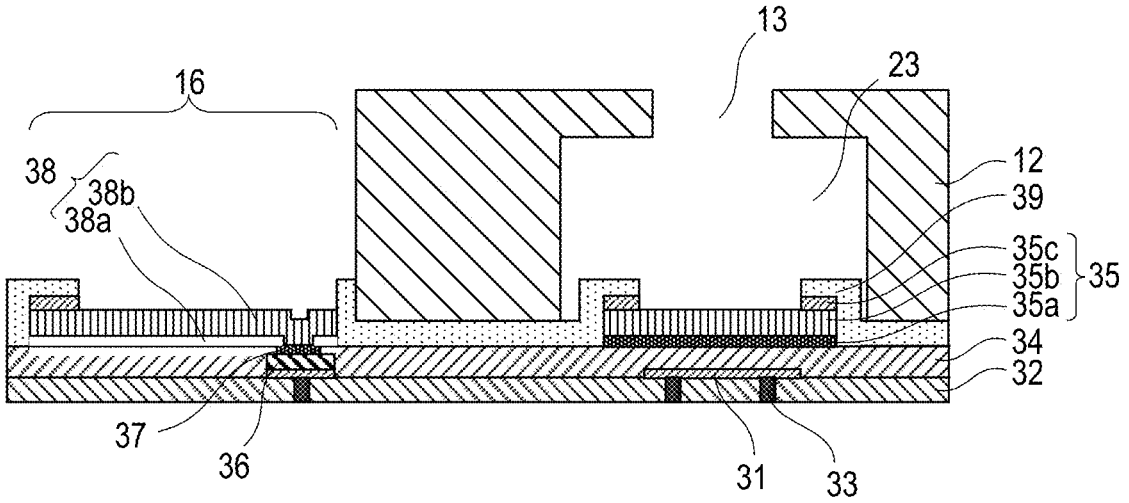
FIG. 8A is a schematic cross-sectional view illustrating a modification example of the embodiment illustrated in FIG. 6.

In the electrode pad portion 16, the Ta film 38*c* as the third layer may be further removed as illustrated in FIG. 8A to expand the pad area. Specifically, in FIG. 8A, the Ta film 38*c* above the wiring lead-out layer 36 and the through-hole 37 is removed from the configuration illustrated in FIG. 6.

Figure 8B:
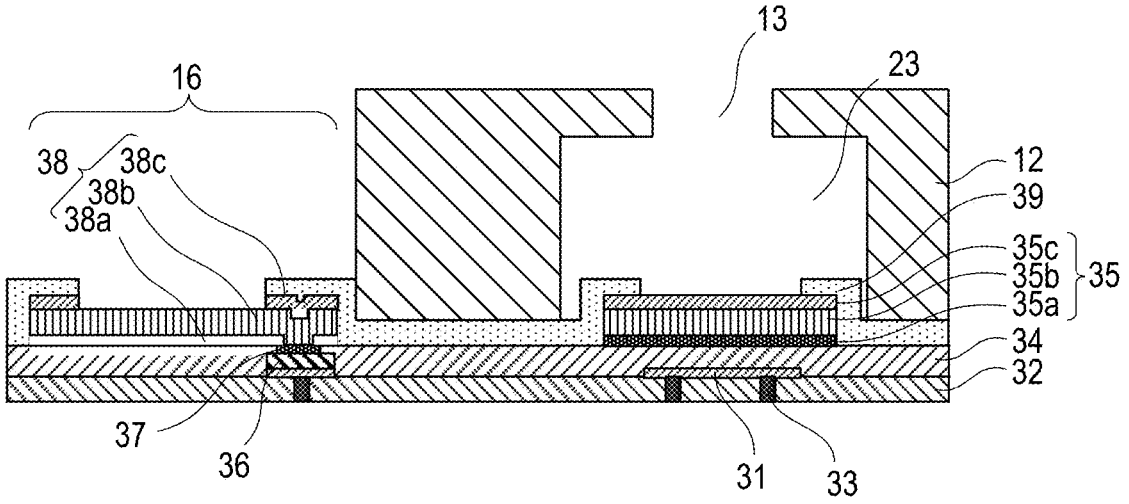
FIG. 8B is a schematic cross-sectional view illustrating another modification example of the embodiment illustrated in FIG. 6.

In addition, in FIG. 6, although the electrode pad portion 16 and the cavitation resistant layer 35 have a common laminated configuration, when the Ir film is common (formed in the same manufacturing step), the laminated configurations may not be all common. For example, in FIG. 8B illustrating a modification example of the present embodiment, the electrode pad portion 16 includes the Ta film 38*a* as the first layer and the Ir film 38*b* as the second layer, and the cavitation resistant layer 35 includes the Ta film 35*a* as the first layer, the Ir film 35*b* as the second layer, and the Ta film 35*c* as the third layer. In the modification example, the outermost layer of the cavitation resistant layer 35 is a Ta film from the viewpoint of protecting the heating element 31, and the electrode pad portion 16 uses an Ir film as the outermost layer of the electrode pad portion 16 in order to suppress the probe mark of the electrical inspection.

Figure 9:
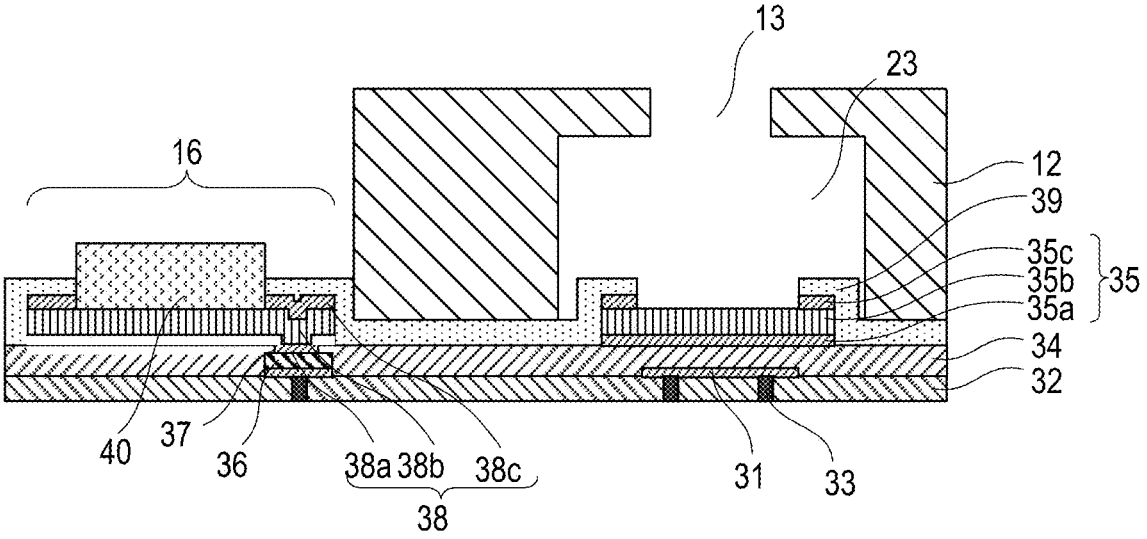
FIG. 9 is a schematic cross-sectional view of a liquid ejection head substrate according to a fourth embodiment to which the present invention can be applied.

In addition, FIG. 9 illustrates a schematic cross-sectional view of a liquid ejection head substrate according to a fourth embodiment to which the present invention can be applied. FIG. 9 illustrates a configuration in which a connection member 40 containing gold (Au) is disposed in the electrode pad portion 16 in contrast to the configuration illustrated in FIG. 6. By disposing the connection member 40 containing Au, the connection reliability with the wire member mainly made of a gold wire is further improved. Although the connection member can be formed by a method similar to that of the gold bump in the related art, since it is not necessary to increase the film thickness, the connection member can be easily formed as a thin film by film formation using a vacuum device such as a sputtering method. In addition, a barrier metal layer such as TiW may be formed between the Ir film and the gold layer. As a result, the diffusion of gold to the lower layer is suppressed.

Since the Ir film 38*b* forming the electrode pad portion 16 can suppress the diffusion of the connection member 40 to the lower layer of gold, it is not necessary to separately provide TiW as a barrier metal layer. That is, the lower surface of the connection member 40 may be provided so as to be in contact with the Ir film. Such a configuration is desirable in that the manufacturing cost can be suppressed. In addition, when a barrier metal layer such as TiW is used, although the barrier metal layer may be dissolved by a solvent used in the manufacturing step due to the configuration, the Ir film 38*b* is desirable in that the Ir film 38*b* is resistant to such a solvent, and there is no concern of dissolution.

The purpose of the present invention is to suppress the thickening of the electrode pad portion 16 as described above, and it is sufficient that the thickness of the connection member 40 is 500 nm or less. Although the lower limit is not particularly limited, the thickness is preferably 50 nm or more, and more preferably 100 nm or more. In addition, the upper surface of the connection member 40 can be lower than the surface of the ejection orifice forming member 12 on which the ejection orifice 13 is formed. As a result, this is because the distance between the surface on which the ejection orifice 13 is formed and the recording medium such as paper can be shortened without being hindered by the thickness of the electrode pad portion 16 and the sealant that covers the electrode pad portion 16, and the image quality can be improved.

EXAMPLE

Specific examples of the configurations of the cavitation resistant layer 35 and the electrode pad portion 16 will be described below with reference to the drawings.

Example 1

In the present example, similar to the above-described embodiment, a configuration and a manufacturing method in a case where an Ir film is used for the cavitation resistant layer 35 will be described with reference to FIGS. 3A to 3E.

FIGS. 3A to 3E are step cross-sectional views illustrating the manufacturing step of the present embodiment.

Figure 3A:
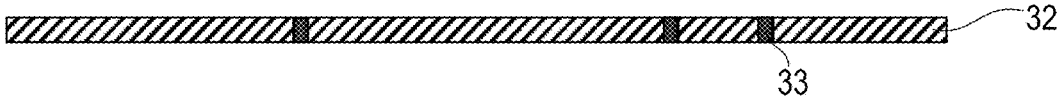
FIG. 3A is a cross-sectional view illustrating a manufacturing step of a heat storage layer and an electrode plug of the liquid ejection head substrate according to the first embodiment to which the present invention can be applied.
Figure 3B:
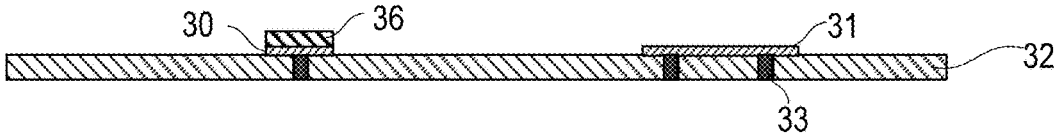
FIG. 3B is a cross-sectional view illustrating a manufacturing step of a wiring lead-out layer and a heating element of the liquid ejection head substrate according to the first embodiment to which the present invention can be applied.

A heat storage layer 32 made of SiO and having a thickness of 1 μm was formed on a substrate (not illustrated) on which a drive element (not illustrated) and a wiring (not illustrated) for driving the drive element are formed, and a portion of the heat storage layer 32 was opened using a dry etching method to provide a through-hole. An electrode plug 33 was formed using tungsten (W) so as to fill the through-hole (FIG. 3A). Furthermore, a cermet material made of TaSiN was formed of a thickness of 15 nm, a wiring electrode layer made of an alloy of aluminum and copper was formed thereon, and a wiring lead-out layer 36 and a heating element 31 were formed by photolithography and dry etching. (FIG. 3B). A connection layer 30 was formed below the wiring lead-out layer 36 with the same material as that of the heating element 31. The heating element 31 was formed to have a size of 15 μm. For example, the heating element 31 can be formed by dry etching lamination of the wiring electrode layer and the cermet material, removing the wiring electrode layer on the cermet material, and further dry etching the cermet material if necessary. Although a lower drive element (not illustrated) is connected to the heating element 31 and the wiring electrode layer formed in a later step through the electrode plug 33, supplying power from the wiring electrode layer enables electrical connection to the heating element 31 instead of using the electrode plug.

Figure 3C:
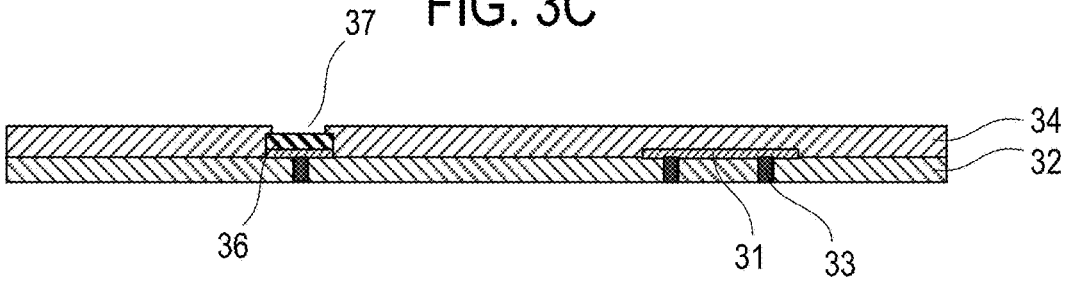
FIG. 3C is a cross-sectional view illustrating a manufacturing step of an insulation protection layer of the liquid ejection head substrate according to the first embodiment to which the present invention can be applied.

Subsequently, an insulation protection layer 34 made of SiN was formed of a thickness of 200 nm so as to cover the heating element 31 and the wiring lead-out layer 36 (FIG. 3C). Here, although the film thickness of the insulation protection layer 34 is set to 200 nm from the viewpoint of insulating property, it may be a thickness of 100 nm or more, and more preferably formed of a thickness of 100 nm or more to 500 nm or less from the viewpoint of heat conduction to the liquid. Next, a mask (not illustrated) was formed on the insulation protection layer 34 by photolithography, and a through-hole 37 was formed in the insulation protection layer 34 to expose a portion of the wiring lead-out layer 36.

Figure 3D:
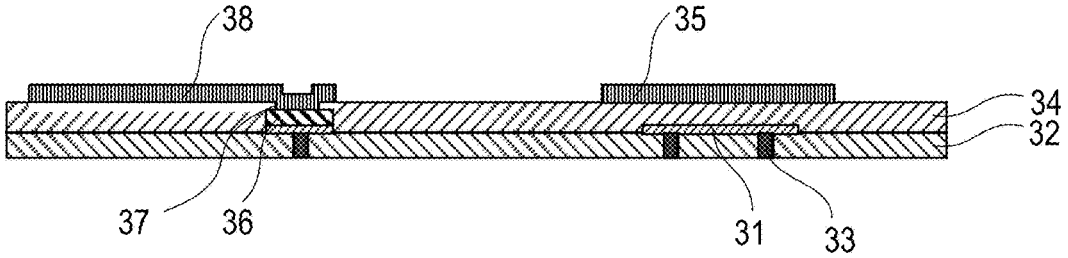
FIG. 3D is a cross-sectional view illustrating a manufacturing step of an upper layer of an electrode pad portion and a cavitation resistant layer of the liquid ejection head substrate according to the first embodiment to which the present invention can be applied.
Figure 3E:
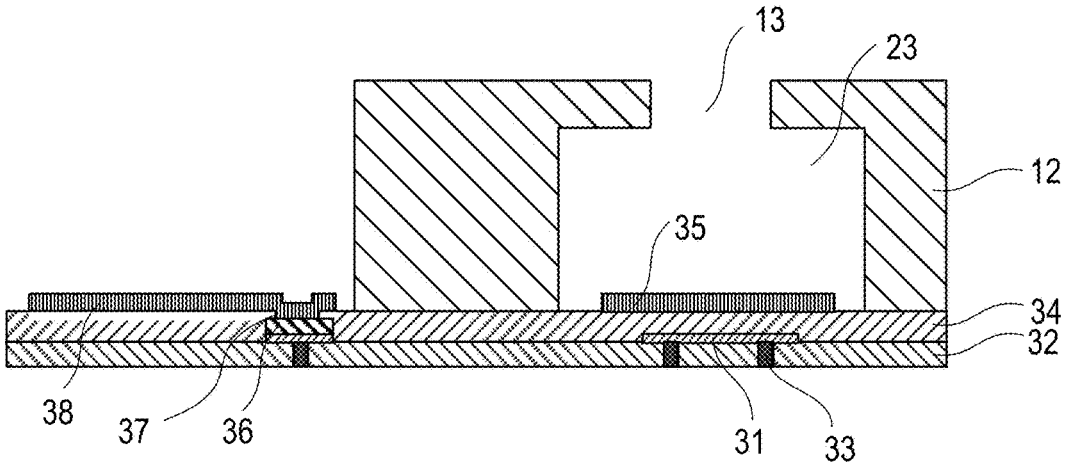
FIG. 3E is a cross-sectional view illustrating a manufacturing step of the liquid ejection head substrate according to the first embodiment to which the present invention can be applied.

Next, a layer made of iridium (Ir) having a thickness of 100 nm was formed on the entire surface, and the layer made of Ir was etched to form an upper layer 38 of the electrode pad portion 16 and a cavitation resistant layer 35 (FIG. 3D). The Ir film thickness may be any thickness that satisfies the cavitation resistance, and is preferably 20 nm or more. Furthermore, from the viewpoint of workability, the thickness is more preferably 20 nm or more to 300 nm or less. In addition, in the electrode pad portion 16, the upper layer 38 made of Ir formed in the same layer as the cavitation resistant layer 35 was connected to the wiring lead-out layer 36 through the through-hole 37, and Ir was exposed on the outermost layer of the electrode pad portion 16.

Next, after forming a liquid supply path and a nozzle material on the substrate and a cover plate on the rear surface side of the substrate (not illustrated), an electrical inspection was performed. A rhenium tungsten probe having a tip end diameter of 20 μm, which is a general probe, was used for the electrical inspection. In addition, the overdrive amount during probing was set to 60 μm. The surface of the electrode pad portion 16 after the electrical inspection was observed with a laser microscope, and no physical damage and deformation due to probing occurred. That is, as in the present example, even in a case where the electrical inspection was performed during the step, the effect of probing was not observed. In addition, since Ir is a noble metal film that does not form a natural oxide film in the air atmosphere at room temperature, probing can be performed stably and the inspection can be performed without any problem.

Next, on the Ir of the electrode pad portion 16, a wire member 41 made of gold was wire-bonded (FIG. 2B) for electrical connection with an external substrate. The wire bonding includes a ball bonding method, a wedge bonding method, and in the present example, the ball bonding method is used. In addition, the wire diameter of the wire member 41 used was 25 μm.

In the present embodiment, as described above, there is no physical damage and deformation on the surface of the electrode pad portion 16 due to probing. Therefore, the electrical connection reliability of the electrode pad portion 16 is improved as compared with the case where there is damage due to probing. In addition, since it is not necessary to form a thick film for hiding the probe mark, it is possible to provide a liquid ejection head corresponding to miniaturization of ejection.

Example 2

In the present example, the configuration of the cavitation resistant layer 35 in Example 1 has a two-layer configuration of an Ir layer 35*b* as the upper layer and a Ta layer 35*a* as the lower layer as illustrated in FIG. 5. Other steps were the same as those in Example 1 to obtain a liquid ejection head in the present example. At this time, the Ir layer and the Ta layer were formed to have film thicknesses of 70 nm and 30 nm, respectively.

With such a configuration, the adhesion between the lower insulation protection layer 34 and the cavitation resistant layer 35 was further improved, and a more reliable liquid ejection head could be supplied.

In addition, in the electrode pad portion 16, as illustrated in FIG. 5, the upper layer 38 has a two-layer structure of a first layer 38*a* formed in the same layer as the Ta layer 35*a* and a second layer 38*b* formed in the same layer as the Ir layer 35*b*.

Example 3

Figure 7A:
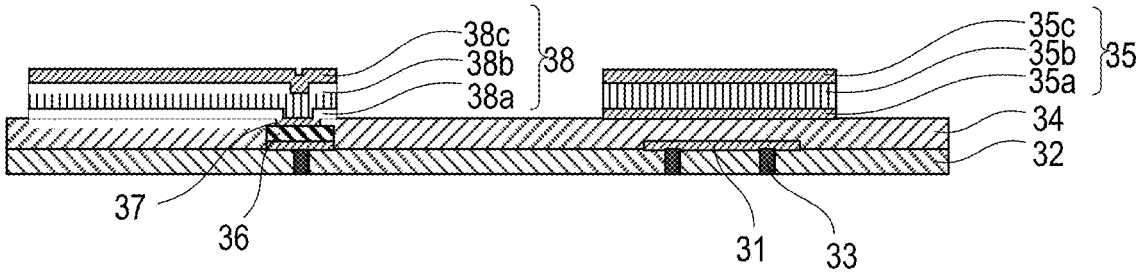
FIG. 7A is a cross-sectional view illustrating a portion of a manufacturing step of the liquid ejection head substrate according to the embodiment illustrated in FIG. 6.
Figure 7B:
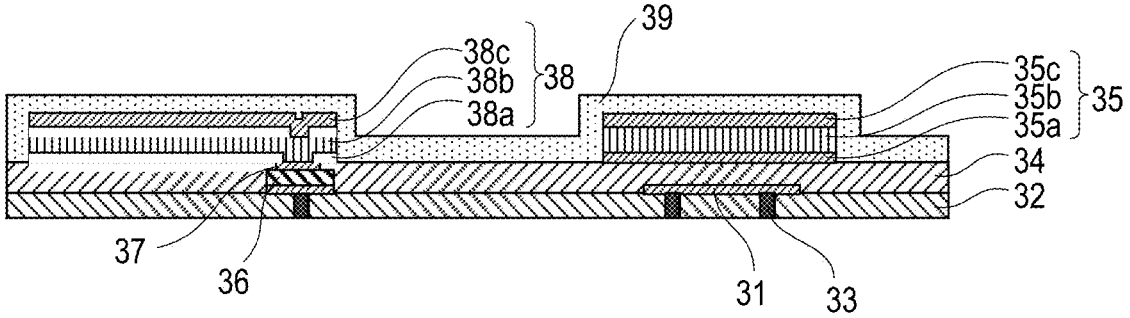
FIG. 7B is a cross-sectional view illustrating a portion of the manufacturing step of the liquid ejection head substrate according to the embodiment illustrated in FIG. 6.
Figure 7C:
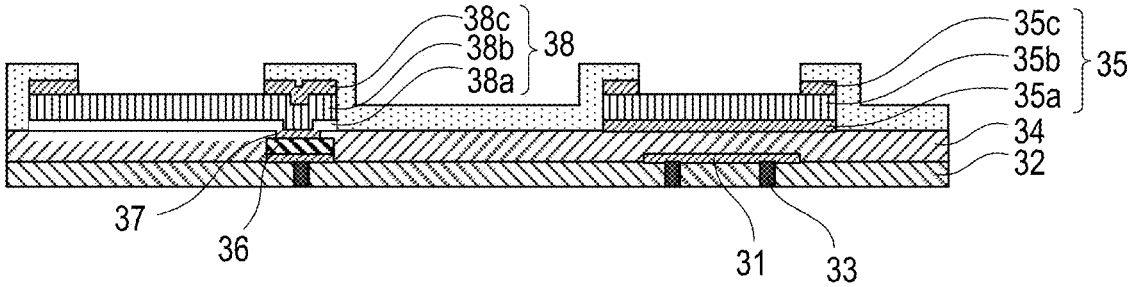
FIG. 7C is a cross-sectional view illustrating a portion of the manufacturing step of the liquid ejection head substrate according to the embodiment illustrated in FIG. 6.

FIG. 6 is a schematic cross-sectional view of the present example, and FIGS. 7A to 7C are sectional step drawings for describing a manufacturing step of the present example. Differences from Example 1 will be described below.

A substrate similar to that of Example 1 was prepared, and the components before the formation of the cavitation resistant layer 35 (FIG. 3C) were prepared in the same step.

Thereafter, as illustrated in FIG. 7A, in the present example, a layer serving as a cavitation resistant layer was formed from the top, with three layers of a Ta film 35*c* as the third layer, an Ir film 35*b* as the second layer, and a Ta film 35*a* as the first layer. The thickness of the Ta film 35*c* was 70 nm, the thickness of the Ir film 35*b* was 70 nm, and the thickness of the Ta film 35*a* was 30 nm. The electrode pad portion 16 also includes a first layer 38*a* that is the same layer as the Ta film 35*a*, a second layer 38*b* that is the same layer as the Ir film 35*b*, and a third layer 38*c* that is the same layer as the Ta film 35*c* as the upper layer 38.

SiCN was formed thereon with a thickness of 200 nm as an adhesion improving layer 39 between the ejection orifice forming member 12 and the substrate so as to cover the entire substrate (FIG. 7B). By disposing such an adhesion improving layer 39, the reliability of the liquid ejection head particularly for the liquid contact portion is further improved.

Thereafter, the adhesion improving layer 39 on the heating element 31 and the electrode pad portion 16 and the Ta film 35*c* as the upper layer and the third layer 38*c* are removed by dry etching to expose the Ir film 35*b* and the second layer 38*b* (FIG. 7C). Also in this case, the Ir surface can be exposed without reducing the film thickness of the Ir film by performing chemical etching with one of chlorine gas and fluorine gas at the time of etching.

In the present example, the electrical inspection of the substrate was performed immediately after the opening of the pad portion, that is, after FIG. 7C. As described in Example 1, also in the present example, it was confirmed that the exposed surface of the electrode pad portion 16 at the time of probing was the second layer 38*b* made of Ir, and the second layer 38*b* was not physically damaged and deformed.

Similar to Example 1, in a subsequent step, a liquid supply path and an ejection orifice forming member were formed on the substrate, and a cover plate was formed on the rear surface side of the substrate.

Thereafter, similar to Example 1, the electrode pad portion 16 was bonded to a gold wire. Similar to Examples 1 and 2, in the present example, the electrical connection reliability of the electrode pad portion 16 is improved as compared with the case where there is damage due to probing.

Example 4

FIG. 9 is a schematic cross-sectional view of the present example.

Similar to Example 3, in the present example, the electrical inspection was performed after the electrode pad portion 16 was opened (FIG. 7C). Furthermore, in order to improve the connection reliability of the electrode pad portion 16 at the timing of wire bonding, a connection member made of Au was formed on the electrode pad portion 16 by the sputtering method before forming the liquid supply path and the ejection orifice forming member 12. The thickness of the connection member 40 was 500 nm. In addition, in this configuration, a barrier metal layer (not illustrated) made of TiW may be inserted between the connection member and Ir.

Thereafter, similar to Example 3, the liquid supply path and the ejection orifice forming member 12 were formed and the electrode pad portion 16 in which gold was exposed on the outermost layer was connected to the wire made of gold.

In the present example, since the outermost layer of the electrode pad portion and the bonding material are formed of the same material of gold, the configuration has higher electrical connection reliability than that of the electrode pad portion of the Ir outermost layer of another example.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-133802, filed Jul. 19, 2019, and Japanese Patent Application No. 2020-089788, filed May 22, 2020, which are hereby incorporated by reference herein in their entirety.

What is claimed is:

1. A liquid ejection head substrate comprising:

a heating element that generates thermal energy for ejecting a liquid;

an electrode pad portion for electrical connection with an outside, the electrode pad portion being electrically connected to the heating element; and a cavitation resistant layer formed so as to cover the heating element, wherein the electrode pad portion includes a layer containing one of an iridium metal and an iridium alloy, and at least a portion of the cavitation resistant layer is provided in the same layer with the same material as the layer containing one of the iridium metal and the iridium alloy.

2. The liquid ejection head substrate according to claim 1, wherein an outermost layer of the electrode pad portion is the layer containing one of the iridium metal and the iridium alloy.

3. The liquid ejection head substrate according to claim 1, wherein the electrode pad portion includes a connection member containing gold on an outermost layer.

4. The liquid ejection head substrate according to claim 3, wherein the connection member is formed of a layer containing gold having a film thickness of 500 nm or less.

5. The liquid ejection head substrate according to claim 3, wherein the layer containing one of the iridium metal and the iridium alloy is in contact with a lower surface of the connection member.

6. The liquid ejection head substrate according to claim 3, further comprising:

an ejection orifice forming member that includes an ejection orifice surface provided with a liquid ejection orifice for ejecting a liquid, wherein an upper surface of the connection member is located lower than the ejection orifice surface.

7. The liquid ejection head substrate according to claim 1, wherein a film thickness of the layer containing one of the iridium metal and the iridium alloy in the electrode pad portion is 20 nm or more to 300 nm or less.

8. The liquid ejection head substrate according to claim 1, wherein the electrode pad portion includes a wiring lead-out layer that is formed in a lower layer of the layer containing one of the iridium metal and the iridium alloy, and electrically connects the layer containing one of the iridium metal and the iridium alloy and the heating element, and the layer containing one of the iridium metal and the iridium alloy and the wiring lead-out layer are connected to each other through a through-hole formed in an insulation protection layer between the layer containing one of the iridium metal and the iridium alloy and the wiring lead-out layer.

9. The liquid ejection head substrate according to claim 8, wherein the wiring lead-out layer is a layer containing aluminum.

10. The liquid ejection head substrate according to claim 8, wherein a probe mark is not formed on the wiring lead-out layer.

11. The liquid ejection head substrate according to claim 8, further comprising:

an upper layer that covers the layer containing one of the iridium metal and the iridium alloy at a position corresponding to the through-hole in the layer containing one of the iridium metal and the iridium alloy.

* * * * *